US011226116B2

(12) United States Patent
Phillips et al.

(10) Patent No.: US 11,226,116 B2
(45) Date of Patent: Jan. 18, 2022

(54) AIR CONDITIONING APPLIANCE AND TELESCOPING AIR PLENUM WITH SELF-ADJUSTING DIVIDER

(71) Applicant: Haier US Appliance Solutions, Inc., Wilmington, DE (US)

(72) Inventors: Richard Michael Phillips, Louisville, KY (US); Stephen D. Hatcher, Henryville, IN (US); Christopher Raymond Geisen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 121 days.

(21) Appl. No.: 16/553,353

(22) Filed: Aug. 28, 2019

(65) Prior Publication Data

US 2021/0063028 A1 Mar. 4, 2021

(51) Int. Cl.
*F24F 1/031* (2019.01)
*F24F 1/027* (2019.01)

(52) U.S. Cl.
CPC ..... *F24F 1/031* (2019.02); *F24F 1/027* (2013.01)

(58) Field of Classification Search
CPC . E04B 1/3431; F16L 5/12; F24F 1/027; F24F 1/031; F24F 1/62
See application file for complete search history.

(56) References Cited

U.S. PATENT DOCUMENTS 6,065,296 A * 5/2000 Feger ..... F24F 1/022 62/150
2016/0298871 A1 10/2016 Gillatt
2017/0284683 A1* 10/2017 Gallo ..... F24F 13/0245
2018/0106507 A1 4/2018 Eicher et al.

FOREIGN PATENT DOCUMENTS

CN 202254172 U 5/2015

OTHER PUBLICATIONS

GE Appliances, Single Packaged Vertical Units, Architects Engineers Data Manual, Pub No. 20-A0125, Louisville, KY, pp. 1-20.
Total Home Supply, Friedrich VHA24K Vert-I-Pak 24000 BTU Class Single Vertical Packaged Air System with Heat Pump (VTAC), pp. 1-6.

* cited by examiner

*Primary Examiner* — Schyler S Sanks
(74) *Attorney, Agent, or Firm* — Dority & Manning, P.A.

(57) ABSTRACT

An air conditioning appliance may have a telescoping plenum attached to a housing of the air conditioning appliance. The telescoping plenum may be receivable within a wall channel defined by a structure wall along an axial direction. The telescoping plenum may include an interior portion and an exterior portion. The interior portion may include a duct wall and an outer flange extending radially outward from the duct wall to contact an internal surface of a structure wall. The telescoping plenum may further include a divider wall defining an upper passage and a lower passage within the telescoping plenum. The divider wall includes an interior divider panel fixed to the interior portion and an exterior divider panel fixed to the exterior portion. Each of the interior divider panel and the exterior divider panel is axially slidable along the other of the interior divider panel and the exterior divider panel.

14 Claims, 5 Drawing Sheets

AIR CONDITIONING APPLIANCE AND TELESCOPING AIR PLENUM WITH SELF-ADJUSTING DIVIDER

FIELD OF THE INVENTION

The present subject matter relates generally to air conditioning appliances, and more particularly to air plenums for air conditioning appliances.

BACKGROUND OF THE INVENTION

Air conditioner or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Some conventional air conditioning appliances include a plenum for directing air to or from an outdoor portion of the air conditioning appliance. When installed, the plenum may be positioned through a wall of the building or structure. The wall may be an outer wall such that the plenum extends from an interior portion of the building to an exterior portion of the building. Thus, a portion of the plenum will often extend to and be visible from an area outside of the building. However, it is generally preferable (e.g., for aesthetics, support, sizing, performance, etc.) to minimize the amount of plenum exposed to the exterior environment.

The lack of standard wall sizes (e.g., thickness) makes sizing plenums difficult. Although multi-piece plenums sizes have been attempted to accommodate a range of wall, these structures present several drawbacks. For instance, such multi-piece plenums include a divider wall which is typically separately installed and adjusted within the plenum after the plenum itself is installed. This extra step of installing and adjusting the divider wall creates additional opportunities for errors, including the possibility that this step may be forgotten entirely.

As a result, further improvements to air conditioners may be advantageous. In particular, it would be useful to provide a multi-piece plenum capable of being installed with a minimal number of steps to reduce the chances of errors or omissions during installation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a telescoping plenum for an air conditioning appliance is provided. The telescoping plenum may include an interior portion and an exterior portion. The interior portion may include a duct wall and an outer flange extending radially outward from the duct wall to contact an internal surface of a structure wall. The exterior portion may include a duct wall having a flange-less outer surface to selectively pass through the wall channel along an axial direction. The telescoping plenum also includes a divider wall defining an upper passage and a lower passage within the telescoping plenum. The divider wall includes an interior divider panel fixed to the interior portion and an exterior divider panel fixed to the exterior portion. Each of the interior divider panel and the exterior divider panel is axially slidable along the other of the interior divider panel and the exterior divider panel.

In another exemplary aspect of the present disclosure, a single-package air conditioner unit is provided. The single-package air conditioner unit may include a housing, an outdoor heat exchanger assembly, an indoor heat exchanger assembly, a compressor, and a telescoping plenum. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and comprising an indoor heat exchanger and an indoor fan. The compressor may be in fluid communication with the outdoor heat exchanger and the indoor heat exchanger to circulate a refrigerant between the outdoor heat exchanger and the indoor heat exchanger. The telescoping plenum may be attached to the housing and receivable within a wall channel defined by a structure wall along an axial direction. The telescoping plenum may include an interior portion and an exterior portion. The interior portion may include a duct wall and an outer flange extending radially outward from the duct wall to contact an internal surface of the structure wall. The exterior portion may include a duct wall having a flange-less outer surface to selectively pass through the wall channel along the axial direction. The exterior portion may be in slidable engagement with the interior portion to move along the axial direction. The telescoping plenum also includes a divider wall defining an upper passage and a lower passage within the telescoping plenum. The divider wall includes an interior divider panel fixed to the interior portion and an exterior divider panel fixed to the exterior portion. Each of the interior divider panel and the exterior divider panel is axially slidable along the other of the interior divider panel and the exterior divider panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
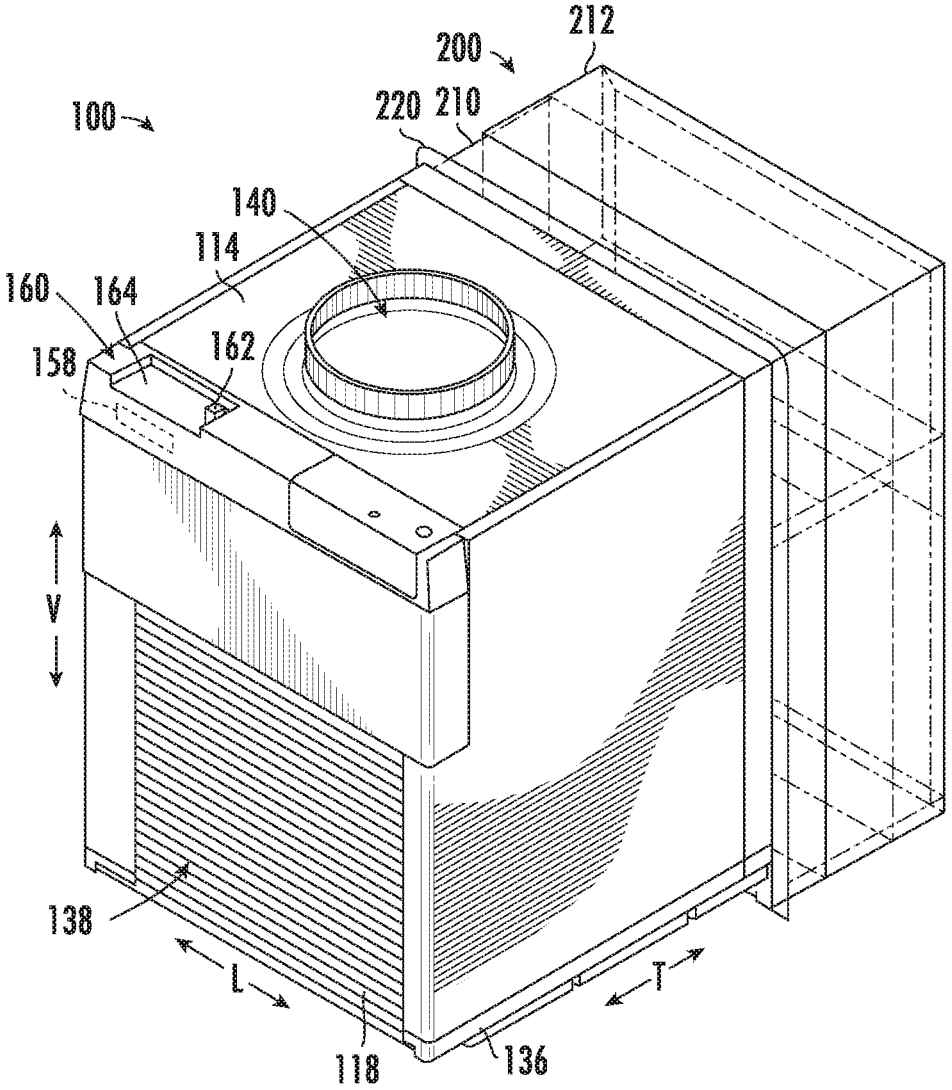
FIG. 1 provides a perspective view of an air conditioning appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
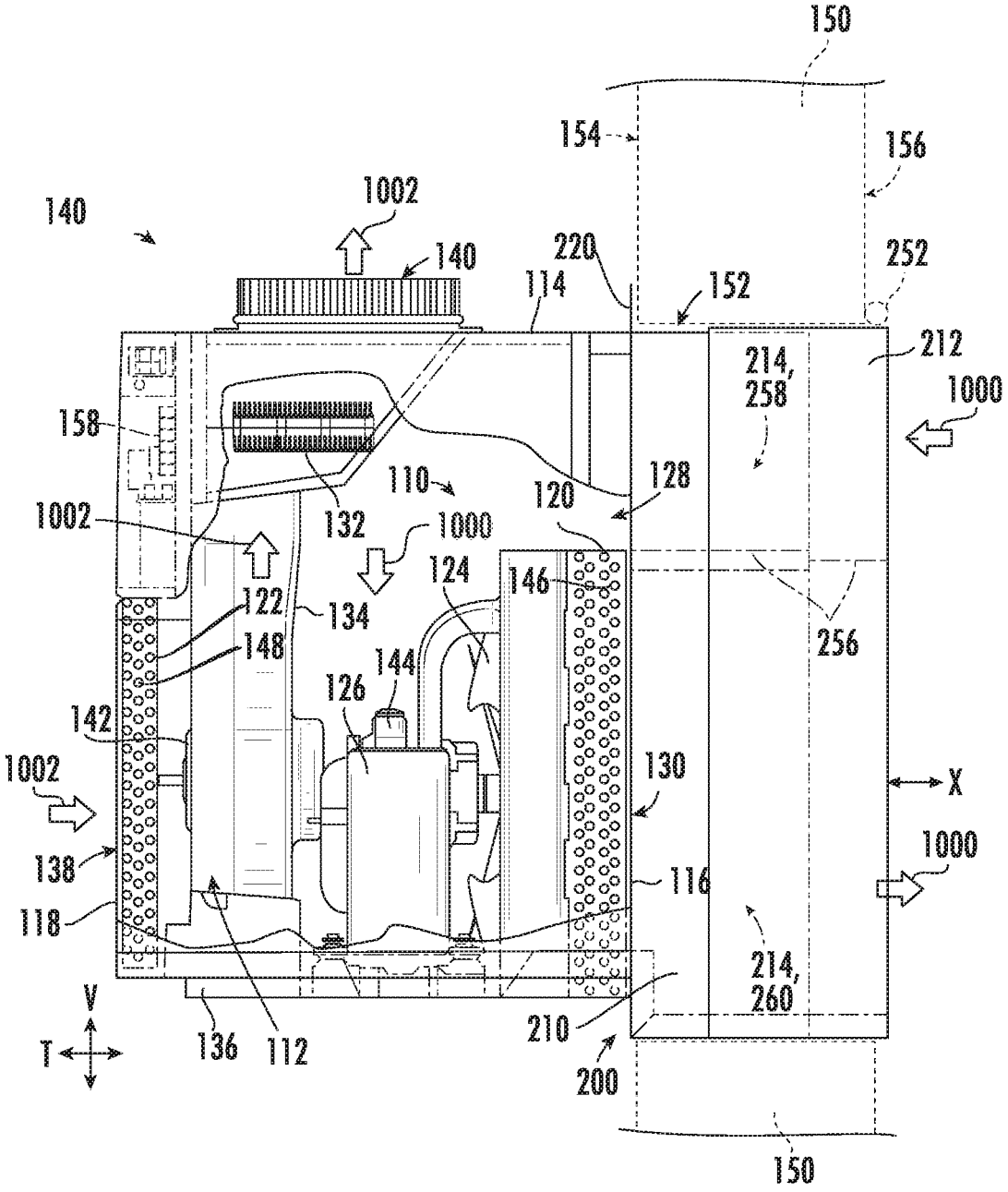
FIG. 2 provides a partially-transparent elevation view of the exemplary air conditioner unit of FIG. 1.

Turning now to the figures, FIGS. 1 and 2 illustrate an exemplary air conditioner appliance (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is perpendicular to each other, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, outdoor air 1000 may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, a blower fan 142, and a heating unit 132. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

During certain operations, indoor air 1002 may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 (e.g., before passing to bulkhead 134). From blower fan 142, indoor air 1002 may be motivated (e.g., across heating unit 132) and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air from air conditioner 100. It is noted that although indoor outlet 140 is illustrated as generally directing air 1002 upward, it is understood that indoor outlet 140 may be defined in alternative embodiments to direct air 1002 in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

As will be further described in detail below, a telescoping plenum 200 may be provided to direct air to or from housing 114. When installed, telescoping plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). In particular, telescoping plenum 200 extends along an axial direction X (e.g., parallel to the transverse direction T) through a hole or channel 152 in the structure wall 150 that passes from an internal surface 154 to an external surface 156.

The operation of air conditioner 100 including compressor 126 (and thus the sealed system generally), blower fan 142, outdoor fan 124, heating unit 132, and other suitable components may be controlled by a control board or controller 158. Controller 158 may be in communication with (e.g., connected to, via for example a suitable wired or wireless connection) such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Figure 3:
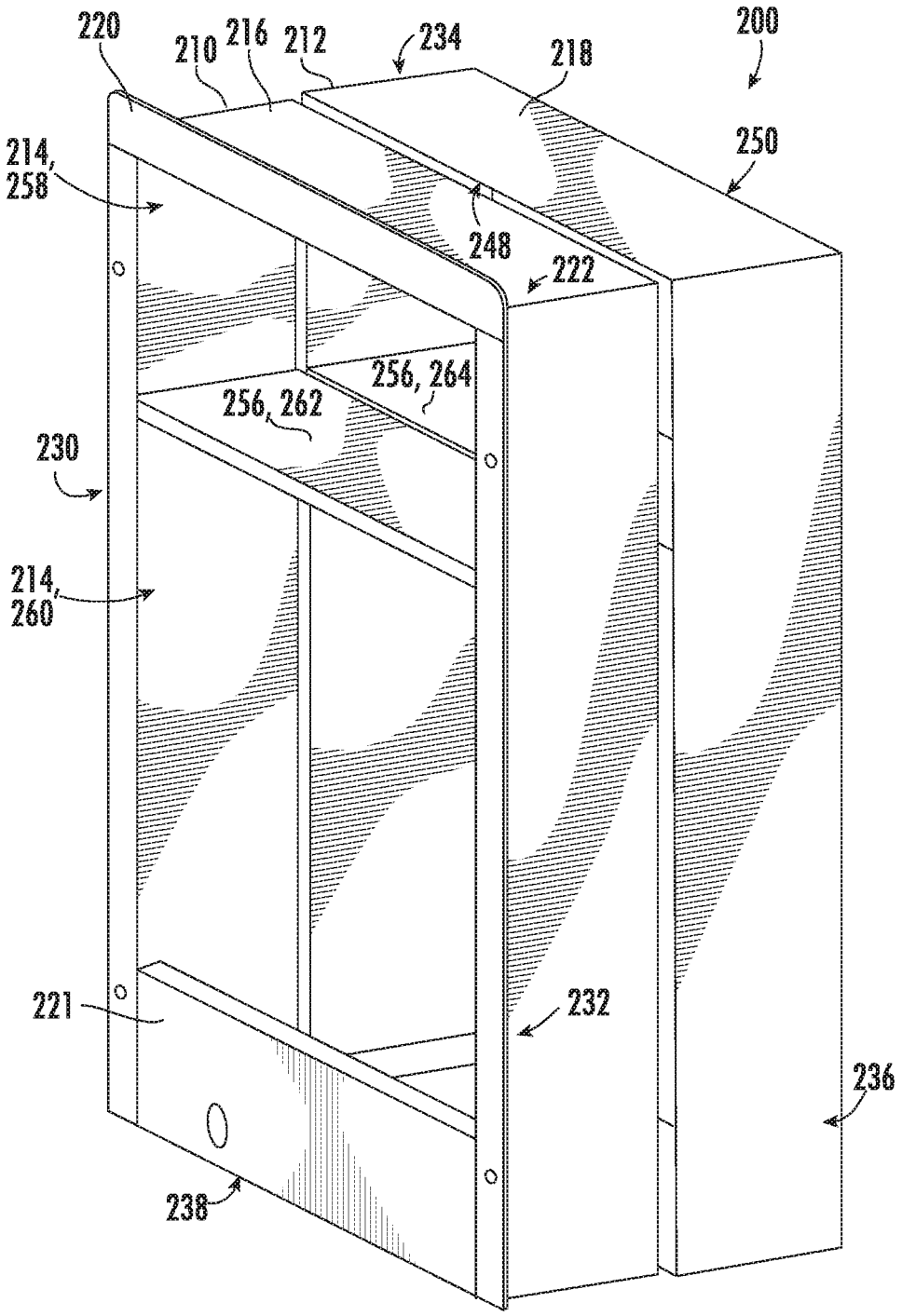
FIG. 3 provides a perspective view of a plenum of an air conditioning appliance according to exemplary embodiments of the present disclosure.
Figure 4:
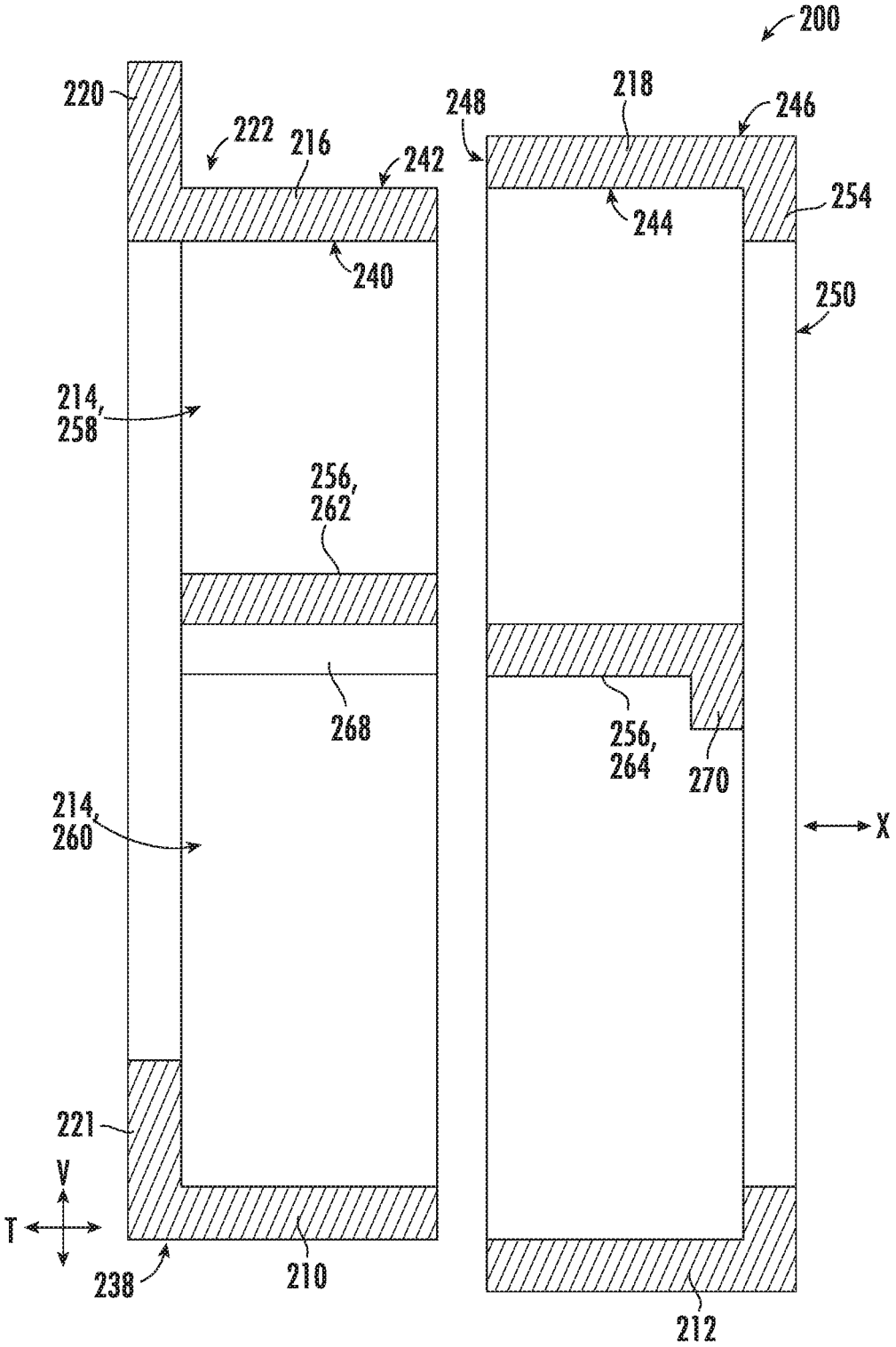
FIG. 4 provides a schematic, longitudinal section view of the exemplary plenum of FIG. 3.
Figure 5:
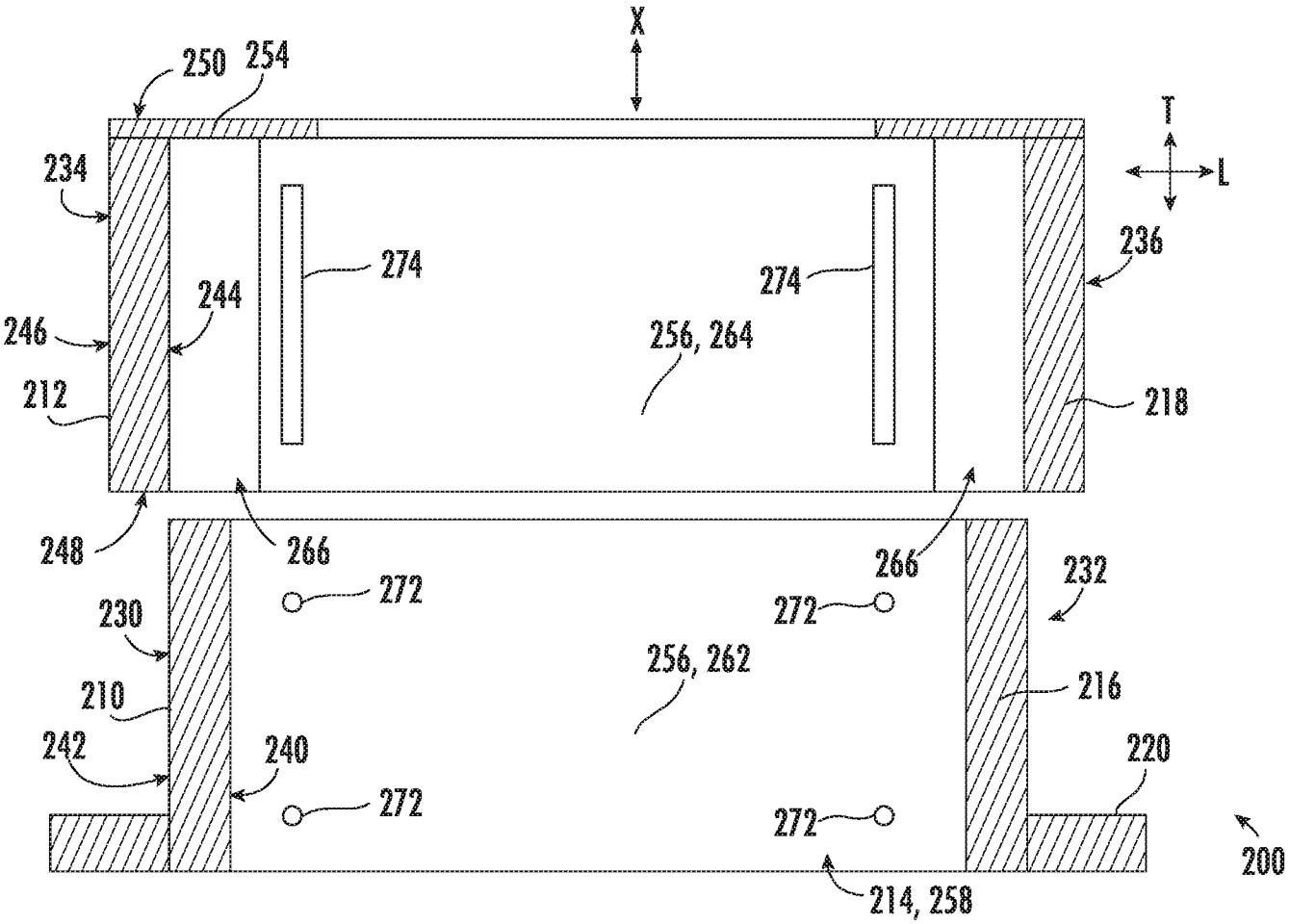
FIG. 5 provides a schematic, top-down section view of the exemplary plenum of FIG. 3.

Turning now especially to FIGS. 2 through 5, an exemplary telescoping plenum 200 will be described in greater detail. FIGS. 3 through 5 in particular provide various views of telescoping plenum 200 in isolation and with an interior portion 210 and an exterior portion 212 separated for clarity.

Although shown as separated in FIGS. 3 through 5, it is noted that the assembled telescoping plenum 200 provides interior portion 210 and exterior portion 212 in sliding engagement (e.g., such that exterior portion 212 is movable along the axial direction X on interior portion 210). For instance, at least one of interior portion 210 and exterior portion 212 may be selectively nested within each other (e.g., such that the nested member is surrounded about the axial direction X, at least in part, by the receiving member). In some such embodiments, interior portion 210 is selectively nested within exterior portion 212, as shown in FIGS. 1 and 2.

Interior portion 210 of telescoping plenum 200 includes a duct wall 216 that is formed about the axial direction X (e.g., when mounted through wall channel 152). Duct wall 216 may be formed according to any suitable hollow shape, such as conduit having a rectangular profile (shown), defining an air channel 214 to guide air 1000 (FIG. 2) therethrough. Moreover, duct wall 216 may be formed from any suitable non-permeable material (e.g., steel, aluminum, or a suitable polymer) for directing or guiding air 1000 therethrough.

When assembled, interior portion 210 is selectively attached to housing 114. Specifically, interior portion 210 may be mounted proximal to outdoor portion 110 or distal to indoor portion 112. In some such embodiments, interior portion 210 is fixed to or mounted against housing 114 (e.g., via one or more suitable mechanical fasteners, adhesives, gasket, etc.) about at least a portion of rear opening 116. The duct wall 216 of interior portion 210 may surround, for instance, outdoor outlet 130. Additionally or alternatively, the duct wall 216 of interior portion 210 may surround outdoor inlet 128.

In certain embodiments, interior portion 210 further includes an outer flange 220 that extends in a radial direction (e.g., perpendicular to the axial direction X) from duct wall 216. Specifically, outer flange 220 extends radially outward (e.g., away from at least a portion of the axial direction X or the duct wall 216 of interior portion 210). Outer flange 220 may thus avoid interference an airflow or flow path within air channel 214.

Outer flange 220 may extend radially outward from all or, alternatively, merely a portion of, duct wall 216. For instance, as shown in the exemplary embodiments, outer flange 220 extends from a top end 222 of the duct wall 216 of interior portion 210. In the illustrated embodiments, outer flange 220 also extends from both sides 230, 232 of the duct wall 216 of interior portion 210. It is understood, however, that alternative embodiments may provide outer flange 220 at another (e.g., one or more) suitable locations along the profile of the duct wall 216 of interior portion 210. Optionally, an internal plate 221 may extend radially inward from duct wall 216 (e.g., at or from the bottom end 238), such that a sub-portion (i.e., less than a whole) of air channel 214 is obstructed.

When assembled, outer flange 220 may be placed against (e.g., directly or indirectly in contact with) an internal surface 154 of the structure wall 150. Thus, outer flange 220 may be located in or pressed into engagement with the internal surface 154 as at least a portion of duct wall 216 of interior portion 210 extends through wall channel 152 (e.g., while housing 114 is held opposite the duct wall 216 of interior portion 210, such as within an interior or indoor area of the structure).

Exterior portion 212 of telescoping plenum 200 includes a duct wall 218 that is formed about the axial direction X (e.g., when mounted through wall channel 152). Duct wall 218 may be formed according to any suitable hollow shape, but is generally formed to complement the shape of the duct wall 216 of interior portion 210. For instance, the duct wall 218 of exterior portion 212 may be formed as a similar shape of the duct wall 216 of interior portion 210, but with a unique size. In some such embodiments, the profile dimensions (e.g., vertical length and lateral width) of exterior portion 212 are larger than the dimensions of interior portion 210, such that interior portion 210 can be selectively nested within exterior portion 212. In other embodiments, the profile dimensions of exterior portion 212 are smaller than the dimensions of interior portion 210, such that exterior portion 212 can be selectively nested within interior portion 210. In certain selectable positions, the duct wall 218 of exterior portion 212 may further define and extend air channel 214 from interior portion 210 (e.g., to guide air therethrough). Similar to interior portion 210, the duct wall 218 of exterior portion 212 may be formed from any suitable non-permeable material (e.g., steel, aluminum, or a suitable polymer) for directing or guiding air 1000 (FIG. 2) therethrough.

When assembled, exterior portion 212 is selectively movable relative to interior portion 210. For instance, exterior portion 212 may be mounted in slidable engagement with interior portion 210 (e.g., to move along the axial direction X as directed or positioned by an installer). Thus, as the distance (e.g., axial or transverse distance) between housing 114 and interior portion 210 remains generally fixed, the distance (e.g., axial or transverse distance) between housing 114 and exterior portion 212 may be selectively varied.

As shown, the duct wall 218 of exterior portion 212 has an inner surface 244 directed toward air channel 214 or interior portion 210, as well as an outer surface 246 directed away from air channel 214 or interior portion 210. In certain embodiments, outer surface 246 is provided as a flange-less outer surface 246. For example, the outer surface 246 may be flange-less at least in that the outer surface 246 does not include a flange or any other projection which extends radially outward therefrom. At the outer surface 246, the duct wall 218 of exterior portion 212 may thus be generally parallel to, for example, axial direction X or transverse direction T and free of any flanges or obstruction thereon (e.g., as provided in conventional plenums). The flange-less outer surface 246 may extend from a front end 248 of exterior portion 212 to a rear end 250 of exterior portion 212.

When assembled, exterior portion 212, including flange-less outer surface 246 may extend through (e.g., selectively pass through) wall channel 152 along the axial direction X. Advantageously, exterior portion 212 may pass through wall channel 152 (e.g., move relative thereto) without striking or contacting either the internal surface 154 or external surface 156 of structure wall 150). In some such embodiments, the rear end 250 is selectively held or positioned outside of wall channel 152, such as beyond the external surface 156 thereof (e.g., in an ambient environment opposite of housing 114 relative to structure wall 150). Optionally, a caulk bead 252 (i.e., adhesive or sealant caulk, illustrated in FIG. 2) may be positioned on or along at least a portion of the flange-less outer surface 246 and join outer surface 246 to the external surface 156 of structure wall 150 (e.g., about or outside from wall channel 152).

Although outer surface 246 may be a flange-less surface (e.g., without any outwardly projecting flanges), an inner lip 254 may extend radially inward from the duct wall 218 of interior portion 210. For instance, inner lip 254 may extend radially inward from inner surface 244 (e.g., toward axial direction X or air channel 214). As shown, only a sub-portion (i.e., less than a whole) of air channel 214 is obstructed by inner lip 254. In some such embodiments, inner lip 254 extends radially inward from the duct wall 216 at one or both of the lateral sides 234, 236.

In some embodiments, telescoping plenum 200 includes a divider wall 256 within air channel 214. When assembled, divider wall 256 defines a separate upper passage 258 and lower passage 260. For instance, divider wall 256 may extend along the lateral direction L from one lateral side of telescoping plenum 200 to the other lateral side. Generally, upper passage 258 and lower passage 260 may divide or define two discrete air flow paths for air channel 214. For instance, upper passage 258 may be defined within telescoping plenum 200 between divider wall 256 and interior portion 210 or exterior portion 212. Similarly, lower passage 260 may be defined within telescoping plenum 200 between divider wall 256 and interior portion 210 or exterior portion 212 (e.g., below upper passage 258 along the vertical direction V). When assembled, upper passage 258 and lower passage 260 may be fluidly isolated by divider wall 256 (e.g., such that air is prevented from passing directly between passages 258 and 260 through divider wall 256, or another portion of telescoping plenum 200). Upper passage 258 may be positioned upstream from outdoor inlet 128. Lower passage 260 may be positioned downstream from outdoor outlet 130.

As shown, divider wall 256 may include a separate interior divider panel and exterior divider panel 264. In some such embodiments, interior divider panel 262 is generally fixed to interior portion 210, and exterior divider panel 264 is fixed to exterior portion 212. Each divider panel 262 and 264 may be fixed to the respective portion 210 and 212 of the plenum 200 in any suitable manner. In some embodiments, the divider panels 262 and 264 may each be fixed to the respective portion 210 or 212 by virtue of being integrally formed with the portion 210 or 212 of a single piece of material, for example, each divider panel 262 and 264 may be formed of a flap on the portion 210 or 212 folded to form the divider panel 262 or 264 within each portion 210 or 212. In other embodiments, each divider panel 262 and 264 may be fixed to the respective portion 210 and 212 of the plenum 200 by a weld joint, such as a linear weld seam or a spot welded weld joint. In additional embodiments, each divider panel 262 and 264 may be fixed to the respective portion 210 and 212 of the plenum 200 with one or more mechanical fasteners, e.g., screws, bolts, rivets, etc. In further embodiments, more than one of the foregoing may be provided in combination, e.g., the folded-over flaps described above may be spot-welded into place after folding.

As exterior portion 212 moves relative to interior portion 210 (e.g., sliding along the axial direction X), so too may exterior divider panel 264 move relative to interior divider panel 262. When assembled, exterior divider panel 264 may rest on or beneath interior divider panel 262. Exterior divider panel 264 may be axially slidable along interior divider panel 262 (e.g., such that exterior and interior divider panels 264, 262 act as a single air-guiding wall).

In certain embodiments, interior divider panel 262 is fixed to the duct wall 216 of interior portion 210. For instance, interior divider panel 262 may be fixed to an inner surface 240 of the duct wall 216 at a first or second side 230, 232 of telescoping plenum 200. Additionally, interior divider panel 262 may include one or more side flaps 268 fixed to the inner surface 240 (e.g., via a suitable mechanical fastener, adhesive, weld, solder, etc.). In some embodiments, interior divider panel 262 spans the entire lateral width from a first side 230 to a second side 232 of interior portion 210. As an example, a discrete side flap 268 may be provided at both first side 230 and second side 232. Optionally, the discrete side flaps 268 may extend downward (e.g., toward lower passage 260) from interior divider panel 262.

In additional or alternative embodiments, exterior divider panel 264 extends partially along or across the lateral width of exterior portion 212 (i.e., not across the entirety of the lateral width defined by exterior portion 212 within air channel 214). In particular, a gap or side channel 266 may be defined between exterior divider panel 264 and an inner surface 244 of the duct wall 218 of exterior portion 212. In some such embodiments, the side channel 266 extends laterally (i.e., along the lateral direction L such that a void is defined along the lateral direction L). Moreover, the side channel 266 may be positioned vertically between upper passage 258 and lower passage 260. Optionally, a discrete side channel 266 may be provided at both the first side 234 and second side 236 of exterior portion 212. The side channel 266 may be sized to accommodate at least a portion of interior portion 210, such as the duct wall 216 or side flap 268 of interior portion 210. Thus, at least a portion of the duct wall 216 of interior portion 210 may be received within side channels 266. In some such embodiments, exterior divider panel 264 is located below (e.g., at a lower relative position along the vertical direction V than) interior divider panel 262.

In optional embodiments, exterior divider panel 264 is fixed to inner lip 254. For instance, exterior divider panel 264 may include a forward flap 270 (e.g., extending downward toward lower passage 260) fixed to inner lip 254 (e.g., via a suitable mechanical fastener, adhesive, weld, solder, etc.). Optionally, forward flap 270 may be fixed to inner lip 254 at both the first side 234 and second side 236 of exterior portion 212.

During installation, exterior portion 212 may be selectively and advantageously moved on interior portion 210 through the wall channel 152 along the axial direction X until a desired position is reached (e.g., until the rear end of exterior portion 212 is located in an ambient environment and spaced apart from the external surface 156 of the structure wall 150). One of more fasteners (e.g., mechanical fasteners—such as screws, nuts, or clips—adhesives, etc.) may be used to secure the relative position of exterior portion 212 to interior portion 210. For instance, one or more set screws may extend through (and join) interior divider panel 262 and exterior divider panel 264. The caulk bead 252 may later be applied to the flange-less outer surface 246, sealing and securing telescoping plenum 200 to the structure wall 150.

In some embodiments, as illustrated in FIG. 5, one of the panels 262 and 264 may include one or more holes 272 and the other of the panels 262 and 264 may include one or more slots 274 aligned with the holes 272 along two directions, e.g., along the lateral direction L and the vertical direction V, such that when the telescoping plenum 200 is fully installed and in the desired final axial position (e.g., along the axial direction X and/or the transverse direction T), the panels 262 and 264 may be locked or secured together with a fastener in each hole 272 which also passes through a portion of the corresponding slot 274 with which the hole 272 is aligned, e.g., a nut and bolt may be used to secure the panels 262 and 264 together.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A telescoping plenum for an air conditioning appliance, the telescoping plenum being receivable within a wall channel defined by a structure wall along an axial direction, the telescoping plenum comprising:

an interior portion comprising a duct wall and an outer flange extending radially outward from the duct wall to contact an internal surface of the structure wall;

an exterior portion comprising a duct wall having a flange-less outer surface to selectively pass through the wall channel along the axial direction, the exterior portion being in slidable engagement with the interior portion to move along the axial direction; and a divider wall defining an upper passage and a lower passage within the telescoping plenum, the divider wall comprising:

an interior divider panel comprising a first flap fixed to the interior portion, the first flap continuously and seamlessly joined to the interior divider panel at a first bend therein; and an exterior divider panel comprising a second flap fixed to the exterior portion, the second flap continuously and seamlessly joined to the interior divider panel at a second bend therein, wherein each of the interior divider panel and the exterior divider panel is axially slidable along the other of the interior divider panel and the exterior divider panel.

2. The telescoping plenum of claim 1, wherein the interior divider panel is integrally joined with the interior portion and the exterior divider panel is integrally joined with the exterior portion.

3. The telescoping plenum of claim 2, wherein the first flap is integrally formed with the interior portion and folded to form the interior divider panel and the second flap is integrally formed with the exterior portion and folded to form the exterior divider panel.

4. The telescoping plenum of claim 1, wherein the interior portion is selectively nested within the exterior portion.

5. The telescoping plenum of claim 1, wherein the interior divider panel is fixed to the duct wall of the interior portion.

6. The telescoping plenum of claim 1, wherein the exterior portion comprises an inner lip extending radially inward from the duct wall of the exterior portion, wherein the second flap is fixed to the inner lip.

7. The telescoping plenum of claim 1, further comprising a caulk bead on the flange-less outer surface to join the flange-less outer surface to an external surface of the structure wall.

8. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger; and a telescoping plenum attached to the housing and receivable within a wall channel defined by a structure wall along an axial direction, the telescoping plenum comprising:

an interior portion comprising a duct wall and an outer flange extending radially outward from the duct wall to contact an internal surface of the structure wall;

an exterior portion comprising a duct wall having a flange-less outer surface to selectively pass through the wall channel along the axial direction, the exterior portion being in slidable engagement with the interior portion to move along the axial direction; and a divider wall defining an upper passage and a lower passage within the telescoping plenum, the divider wall comprising:

an interior divider panel comprising a first flap fixed to the interior portion, the first flap continuously and seamlessly joined to the interior divider panel at a first bend therein; and an exterior divider panel comprising a second flap fixed to the exterior portion, the second flap continuously and seamlessly joined to the interior divider panel at a second bend therein, wherein each of the interior divider panel and the exterior divider panel is axially slidable along the other of the interior divider panel and the exterior divider panel.

9. The single-package air conditioner unit of claim 8, wherein the interior divider panel is integrally joined with the interior portion and the exterior divider panel is integrally joined with the exterior portion.

10. The single-package air conditioner unit of claim 9, wherein the first flap is integrally formed with the interior portion and folded to form the interior divider panel and the second flap is integrally formed with the exterior portion and folded to form the exterior divider panel.

11. The single-package air conditioner unit of claim 8, wherein the interior portion is selectively nested within the exterior portion.

12. The single-package air conditioner unit of claim 8, wherein the interior divider panel is fixed to the duct wall of the interior portion.

13. The single-package air conditioner unit of claim 8, wherein the exterior portion comprises an inner lip extending radially inward from the duct wall of the exterior portion, wherein the second flap is fixed to the inner lip.

14. The single-package air conditioner unit of claim 8, further comprising a caulk bead on the flange-less outer surface to join the flange-less outer surface to an external surface of the structure wall.

* * * * *